US009927177B2

(12) United States Patent
Kim

(10) Patent No.: US 9,927,177 B2
(45) Date of Patent: Mar. 27, 2018

(54) MOLTEN STEEL TREATMENT APPARATUS AND MOLTEN STEEL TREATMENT METHOD

(71) Applicant: POSCO, Pohang-Si (KR)

(72) Inventor: Wook Kim, Pohang-Si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 15/036,196

(22) PCT Filed: Dec. 24, 2013

(86) PCT No.: PCT/KR2013/012127
§ 371 (c)(1),
(2) Date: May 12, 2016

(87) PCT Pub. No.: WO2015/083876
PCT Pub. Date: Jun. 11, 2015

(65) Prior Publication Data

US 2016/0298906 A1 Oct. 13, 2016

(30) Foreign Application Priority Data

Dec. 6, 2013 (KR) ..... 10-2013-0151566

(51) Int. Cl.
*B22D 41/08* (2006.01)
*F27D 21/00* (2006.01)
(Continued)

(52) U.S. Cl.
CPC ..... *F27D 21/00* (2013.01); *B22D 1/007* (2013.01); *B22D 11/11* (2013.01); *B22D 11/16* (2013.01);
(Continued)

(58) Field of Classification Search
CPC ..... B22D 1/007; B22D 11/16; B22D 11/18; B22D 11/186; B22D 11/188
See application file for complete search history.

(56) References Cited

U.S. PATENT DOCUMENTS 3,486,660 A * 12/1969 Heintz ..... B22D 11/181 164/453
2016/0298906 A1* 10/2016 Kim ..... B22D 1/007

FOREIGN PATENT DOCUMENTS

CN 101176914 5/2008
CN 101583447 11/2009
(Continued)

OTHER PUBLICATIONS

International Search Report—PCT/KR2013/012127 dated Sep. 3, 2014.
(Continued)

*Primary Examiner* — Scott Kastler
(74) *Attorney, Agent, or Firm* — Cantor Colburn LLP

(57) ABSTRACT

Provided are a molten steel treatment apparatus and a molten steel treatment method capable of quickly measuring an inclusion adhesion state inside a nozzle during an operation. The molten steel treatment apparatus includes a container, a nozzle equipped in a molten steel tap hole of the container, a liner disposed on a portion of an inner circumferential surface of the nozzle and formed of an ion-conductive material, a power supply for applying electric power to the molten steel and the liner, and a measuring unit for measuring a voltage value or a current value between the molten steel and the liner. The molten steel treatment method includes measuring a voltage value or current value between the molten steel and the liner; and determining a thickness of an inclusion adhering to an interface between the molten steel and the liner by using the voltage value or the current value.

10 Claims, 6 Drawing Sheets

(51) Int. Cl.

| | |
|---|---|
| ***B22D 11/16*** | (2006.01) |
| ***B22D 41/50*** | (2006.01) |
| ***B22D 1/00*** | (2006.01) |
| ***B22D 11/11*** | (2006.01) |
| ***C21C 7/00*** | (2006.01) |

(52) U.S. Cl.
CPC ..... *B22D 41/50* (2013.01); *C21C 7/00* (2013.01); *F27M 2001/02* (2013.01)

(56) References Cited

FOREIGN PATENT DOCUMENTS

| | | |
|---|---|---|
| EP | 2106866 | 10/2009 |
| JP | 2003200242 | 7/2003 |
| JP | 2005066689 | 3/2005 |
| JP | 2005199339 | 7/2005 |
| JP | 2010110766 | 5/2010 |
| JP | 2011147940 | 8/2011 |
| JP | 2012210647 | 11/2012 |
| KR | 200116823 | 7/1998 |
| KR | 1020100078663 | 7/2010 |
| KR | 101031323 | 4/2011 |
| KR | 1020130010392 | 1/2013 |
| WO | 2008090649 | 7/2008 |

OTHER PUBLICATIONS

PCT Written Opinion—PCT/KR2013/012127 issued on Sep. 3, 2014, citing KR 10-2010-0078663, JP 2005-199339, JP 2011-147940, JP 2010-110766 and KR 10-1031323.

European Search Report—European Application No. 13898865.4, issued on Aug. 17, 2016, citing KR 2010 0078663, JP 2005 199339, JP 2011 147940, EP 2 106 866 and Tsukaguchi, et al.

Tsukaguchi, et al., Development of Anti Clogging Immersion Nozzle (Al Nozzle) Technology for Continuous Casting of Steel, Materia Japan, vol. 50, No. 1, Jan. 2011, pp. 27-29.

* cited by examiner

MOLTEN STEEL TREATMENT APPARATUS AND MOLTEN STEEL TREATMENT METHOD

TECHNICAL FIELD

The present disclosure relates to a molten steel treatment apparatus and a molten steel treatment method, and more particularly, to a molten steel treatment apparatus and a molten steel treatment method which are capable of quickly measuring a state in which an inclusion is attached to an inside a nozzle during an operation.

BACKGROUND ART

Continuous casting equipment produces a slab from refined molten steel received from steel-making equipment. In general, continuous casting equipment includes: a ladle in which molten steel subject to refining in steel-making equipment is received; a tundish disposed under the ladle to receive the molten steel from the ladle, and temporarily storing the molten steel; a mold disposed under the tundish to receive the molten steel from the tundish and solidifying the molten steel in a slab-like shape; and a segment disposed under the mold and performing a series of forming operations to manufacture a slab. The tundish receives molten steel from the ladle and provides the mold with the molten steel. The tundish functions to separate an inclusion by floating, to stabilize slag, to prevent molten steel from being re-oxidized, and to distribute the molten steel to a strand. The tundish is manufactured in a hollow container shape and has a space for receiving molten steel therein. A molten steel tap hole is formed in the bottom surface of the tundish, an upper nozzle is insertedly attached to the molten steel tap hole, and the upper nozzle is connected to a submerged entry nozzle provided under the tundish. A predetermined amount of molten steel is received in the tundish, and the molten steel is introduced into the submerged entry nozzle through the molten steel tap hole and the upper nozzle connected to the molten steel tap hole. The molten steel introduced into the submerged entry nozzle is provided to the mold and is solidified in a slab-like shape.

Various kinds of inclusions, such as alumina inclusions may be mixed into the molten steel in the tundish. Various kinds of inclusions mixed into the molten steel are separated by floatation and removed, but a portion thereof is not removed and remains in the molten steel. The remaining inclusion adheres to the submerged entry nozzle to form a skull while the molten steel passes through the submerged entry nozzle to be provided to the mold. The inclusion adhering to the submerged entry nozzle irregularly reduces the inner diameter of the submerged entry nozzle, and thus changes the tap amount of molten steel during an operation. Therefore, molten steel flow in the mold becomes unstable, for example, a deflected flow of molten steel is generated in the mold, a vertical change of the molten steel surface in the mold is caused, or the like. When the molten steel flow inside the mold is unstable, a defect may be easily generated in a solidified shell, and thus, not only the quality of a slab is deteriorated but also a breakout of the slab is generated during an operation, thereby causing a case of operation stoppage. Also, when a great amount of inclusion adheres to the submerged nozzle, a case of nozzle clogging may occur and thus may cause operation stoppage. Hereinafter, as described above, the irregular reduction in the inner diameter of the submerged entry nozzle due to the skull formed by inclusion adhering to the submerged entry nozzle and the clogging of the submerged entry nozzle will be referred to as nozzle clogging, for convenience in description. To suppress the above-mentioned nozzle clogging, for example, Japanese Patent Application Laid-Open Publication No. 2011-147940, Japanese Patent Application Laid-Open Publication No. 2012-210647, Japanese Patent Application Laid-Open Publication No. 2005-199339, and Japanese Patent Application Laid-Open Publication No. 2005-066689 disclose a continuous casting method which derives an electrochemical deoxidization reaction of an inclusion adhering to the submerged entry nozzle by providing an electrode in the submerged entry nozzle. Here, the deoxidization reaction rate is changed according to the intensity of current applied to the electrode, and when the intensity of the applied current is changed corresponding to a current adhesion state, the nozzle clogging can be suppressed more effectively. However, the above-mentioned patent documents disclose a continuous casting method which only suppresses adhesion of a skull by applying a predetermined intensity of current to the inner wall of the submerged entry nozzle, but do not disclose a method capable of responding to the adhesion state of the skull by quickly measuring the adhesion state of an inclusion to an inside the nozzle. Accordingly, to effectively remove the adhering skull corresponding to the adhering state of the skull, a continuous casting method capable of quickly measuring the inclusion adhering state is required.

Meanwhile, in related arts, there is a method for determining whether the nozzle clogging occurs, wherein the change of molten steel surface in the mold is measured to determine whether the nozzle clogging occurs. However, this method indirectly measures the adhesion state of inclusion to the nozzle through the change in molten steel flow, the change being a phenomenon occurring because an inclusion adheres to the nozzle, and it is impossible to quickly detect the states of generation and adhesion of inclusions on the inner wall of the nozzle through this method. Thus, a method for quickly measuring the inclusion adhesion state inside the nozzle to suppress or prevent the nozzle clogging which may be generated during an operation.

(Prior Art Document) Japanese Patent Application Laid-Open Publication No. 2011-147940

(Prior Art Document) Japanese Patent Application Laid-Open Publication No. 2012-210647

(Prior Art Document) Japanese Patent Application Laid-Open Publication No. 2005-199339

(Prior Art Document) Japanese Patent Application Laid-Open Publication No. 2005-066689

DISCLOSURE OF THE INVENTION

Technical Problem

The present disclosure provides a molten steel treatment apparatus and a molten steel treatment method which are capable of quickly measuring an inclusion adhesion state in a nozzle during an operation.

The present disclosure also provides a molten steel treatment apparatus and a molten steel treatment method which are capable of effectively suppressing or preventing the nozzle clogging from occurring during an operation.

The present disclosure also provides a molten steel treatment apparatus and a molten steel treatment method which are capable of improving the stability and productivity of an operation.

Technical Solution

In accordance with an exemplary embodiment, a molten steel treatment apparatus includes: a container having a space for receiving molten steel and a molten steel tap hole formed on a bottom surface thereof so as to tap the molten steel; a nozzle having an inner space through which the molten steel passes and equipped in the molten steel tap hole; a liner which is installed on at least a portion of an inner circumferential surface of the nozzle and is formed of an ion-conductive material; a power supply for supplying electric power to the molten steel and the liner; and a measuring unit for measuring a voltage value or a current value between the molten steel and the liner.

The power supply may apply DC current or DC voltage to the molten steel and the liner.

The measuring unit may measure a voltage value between the molten steel and the liner when the power supply applies DC current to the molten steel and the liner, and may measure a current value between the molten steel and the liner when the power supply supplies DC voltage to the molten steel and the liner.

When the power supply applies DC current to the molten steel and the liner, the measuring unit may measure a voltage value between the molten steel and the liner and may calculate a resistance value by using the applied current value inputted from the power supply and the voltage value; and when the power supply applies DC voltage to the met and the liner, the measuring unit may measure a current value between the molten steel and the liner and may calculate a resistance value by using an applied voltage value inputted from the power supply and the current value.

The liner may contain a solid electrolyte.

The molten steel treatment apparatus may further include a liner electrode disposed between the nozzle and the liner.

The power supply may include a DC power source capable of applying DC current or DC voltage to the molten steel and the liner, wherein a negative terminal of the DC power source may be connected to the molten steel, and a positive terminal of the DC power source may be connected to the liner electrode.

The nozzle may contain an electrically conductive material, and the power supply may include a DC power source capable of applying DC current or DC voltage to the molten steel and the liner, wherein a negative terminal of the DC power source may be connected to the molten steel, and a positive terminal of the DC power source may be connected to the nozzle.

The measuring unit may include: a measuring part connected to the power supply and configured to measure the voltage value or the current value between the molten steel and the liner; an arithmetic part connected to the measuring part, and configured to calculate a resistance value by using the voltage value or the current value inputted from the measuring part and an applied current value or an applied voltage value inputted from the power supply; and a determination part connected to the arithmetic part, configured to determine a thickness of the inclusion adhering to an interface between the molten steel and the liner by comparing a resistance value inputted from the arithmetic part with a preset reference resistance value, and configured to determine a thickness of the inclusion adhering to the interface by comparing a voltage value or a current value inputted from the measuring part with a preset reference voltage value or reference current value.

In accordance with an exemplary embodiment, a molten steel treatment method includes: preparing molten steel in a container; tapping the molten steel prepared in the container; applying electric power to the molten steel and a liner disposed on an inner circumferential surface of a nozzle for tapping the molten steel; measuring a voltage value or current value between the molten steel and the liner; and determining a thickness of an inclusion adhering to an interface between the molten steel and the liner by using the voltage value or the current value.

In the applying of electric power, a negative terminal of a DC power source may be connected to the molten steel, and a positive terminal of the DC power source may be connected to a liner electrode disposed between the liner and the nozzle or the nozzle, and thus, DC current or DC voltage may be applied to the molten steel and the liner.

In the measuring of the voltage value or current value, when DC current is applied to the molten steel and the liner, a voltage value between the molten steel and the liner may be measured, and when DC voltage is applied to the molten steel and the liner, a current value between the molten steel and the liner may be measured.

After the measuring of the voltage value or the current value, calculating the resistance value between the molten steel and the liner may be performed; in the calculating of the resistance value, when DC current is applied to the molten steel and the liner, a resistance value may be calculated by using an applied current value of the DC current and the voltage value, and when DC voltage is applied to the molten steel and the liner, the resistance value may be calculated by using an applied voltage value of the DC voltage and the current value.

Before the determining of a thickness of the inclusion, determining an adhesion state of the inclusion may be performed; in the determining of the adhesion state of the inclusion: when the voltage value is equal to or more than the reference voltage value, the current value is equal to or less than the reference current value, or the resistance value is equal to or more than the reference resistance value, the interface may be determined as an adhesion state of the inclusion by comparing the voltage value, the current value, or the resistance value and the preset reference voltage value, reference current value, reference resistance value, and when the voltage value is less than the reference voltage value, the current value is more than the reference current value, or the resistance value is less than the resistance value, the interface may be determined as a non-adhesion state of the inclusion.

In the determining of the thickness of the inclusion: when the interface is determined as an adhesion state of the inclusion, the thickness of the inclusion adhering to the interface may be determined to be increased as the voltage value or the resistance value is increased or as the current value is decreased, the thickness of the inclusion adhering to the interface may be determined to be decreased as the voltage value or the resistance value is decreased or as the current value is increased.

After the determining of the thickness of the inclusion, a subsequent step according to the thickness of the inclusion may be performed; and in the performing of the subsequent step: when the interface is determined to be the adhesion state of the inclusion, a tap rate of the molten steel may be increased or a current value between the molten steel and the liner may be increased; and when the interface is determined to be the non-adhesion state of the inclusion, an tap rate of the molten steel may be maintained or a current value between the molten steel and the liner may be maintained.

Advantageous Effects

In accordance with an exemplary embodiment, a measuring unit capable of quickly measuring the inclusion adhesion state of a nozzle is provided, and the inclusion adhesion state inside the nozzle may be quickly measured during an operation by using the measuring unit.

Through this, it is possible to effectively suppress or prevent nozzle clogging from occurring in treating molten steel, and thus, it is possible to stably perform operation by preventing equipment from being damaged by the nozzle clogging.

For example, when applied to a continuous casting equipment, the measuring unit continuously measures a voltage value or a current value between molten steel and the nozzle during an operation, and calculates a resistance value on the basis of the measured value and a current or voltage value of a power source applied between the molten steel and the nozzle. Comparing this with a preset resistance value, the adhesion state of the inclusion to an inside the nozzle and the increase or decrease of the thickness of the adhering inclusion are determined, and thus, it is possible to quickly determine the nozzle clogging state. Accordingly, the nozzle clogging can be solved by performing a subsequent process. More specifically, in case of the nozzle clogging, the opening of the nozzle is increased to increase the tap rate of the molten steel, and thus, the separation of an inclusion is promoted. Also, the current value of an applied power source is increased to promote the electrochemical oxidization of an inclusion. Thus, the nozzle clogging can be quickly solved.

Through this, it is possible to effectively prevent defects in a solidified shell and breakout which are caused by the nozzle clogging, and thus, damage to equipment and operation stoppage can be prevented. Thus, it is possible to stably perform operation and to thereby improve productivity.

DESCRIPTION OF REFERENCE CHARACTERS

Figure 1:
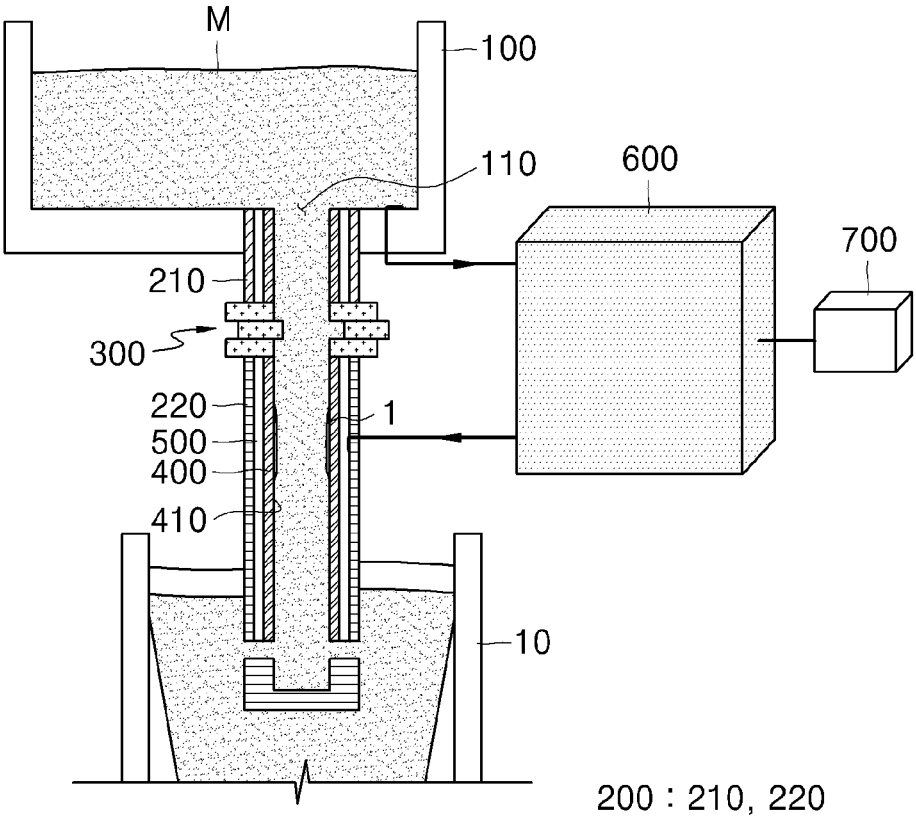
FIG. 1 is a schematic view of a molten steel treatment apparatus in accordance with an exemplary embodiment.

100: Container
200: Nozzle
400: Liner
410: Interface
500: Liner electrode
600: Power supply
700: Measuring unit

MODE FOR CARRYING OUT THE INVENTION

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. In the drawings, the dimensions of the elements may be exaggerated to describe the embodiments, and like reference symbols refer to like elements throughout.

Figure 2:
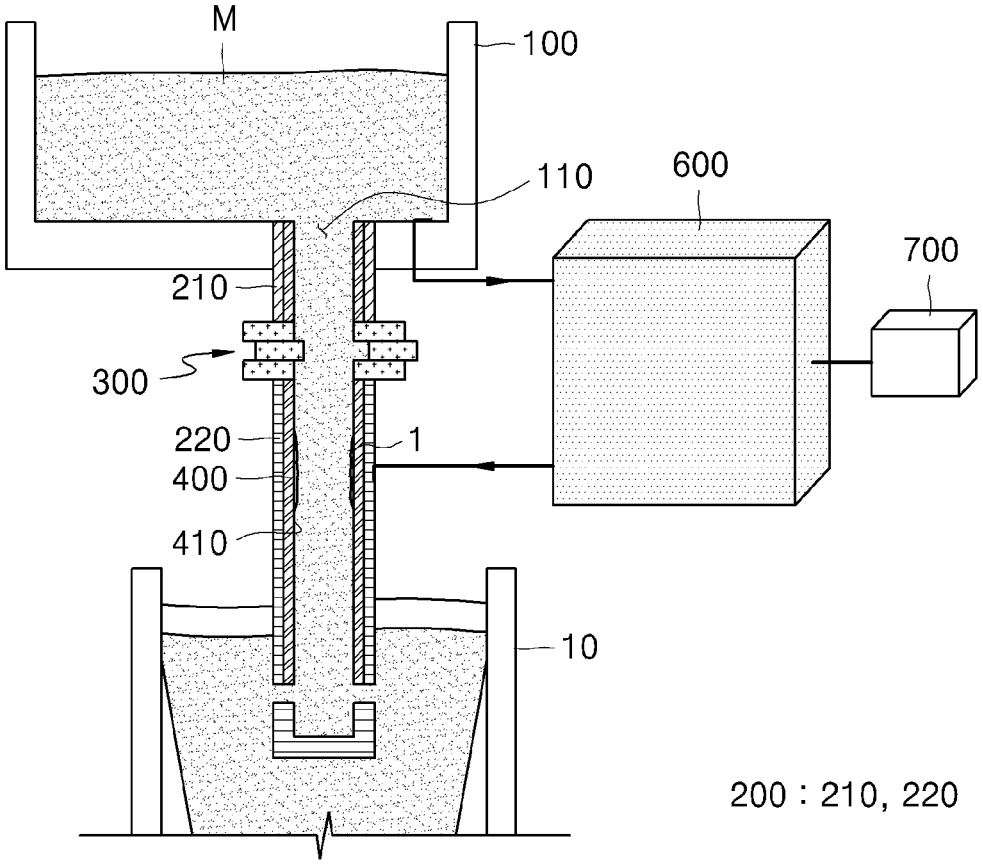
FIGS. 2 and 3 are schematic views of molten steel treatment apparatuses in accordance with modified embodiments.
Figure 3:
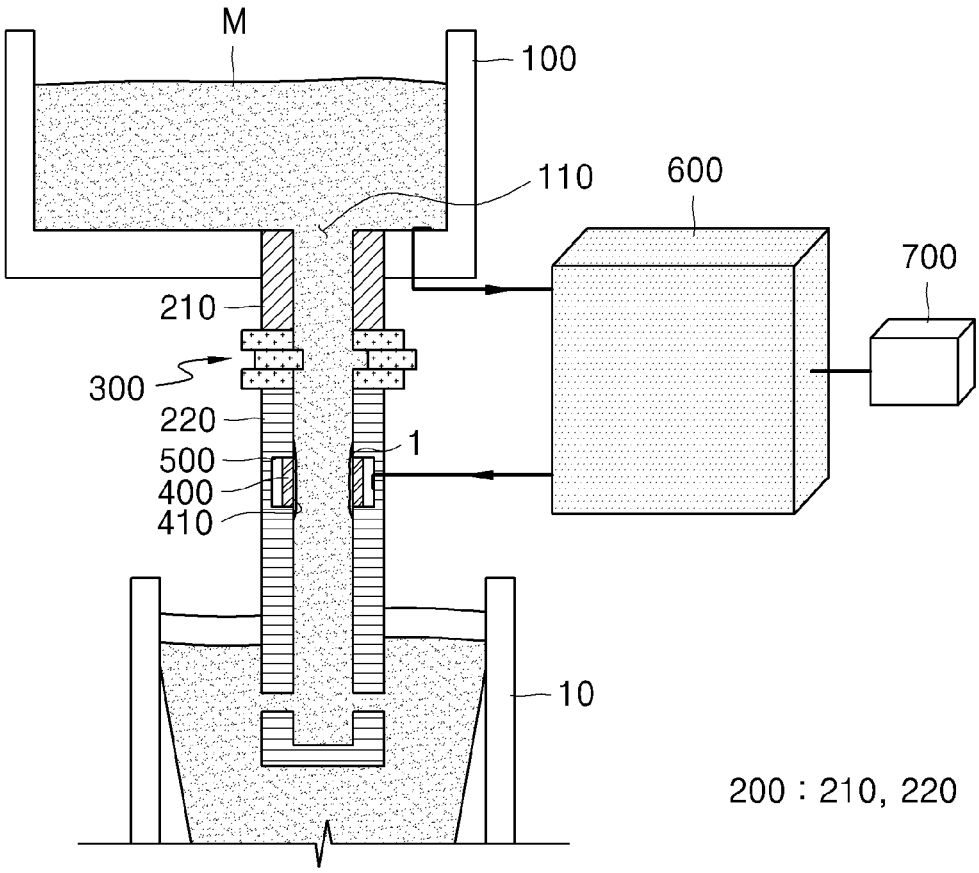
Figure 4:
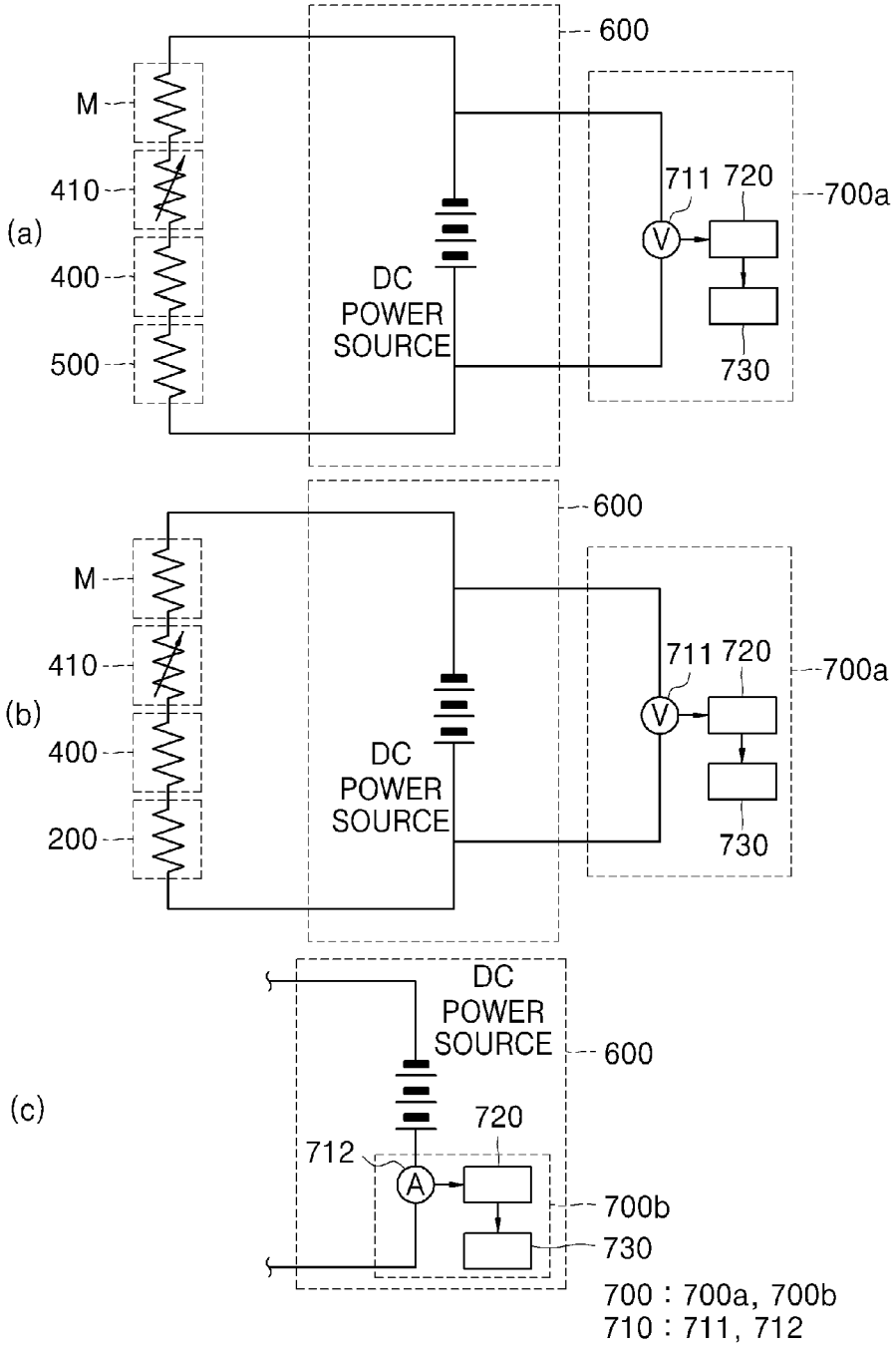
FIG. 4 is a schematic view of an electrical circuit provided in a molten steel treatment apparatus in accordance with an exemplary embodiment.
Figure 5:
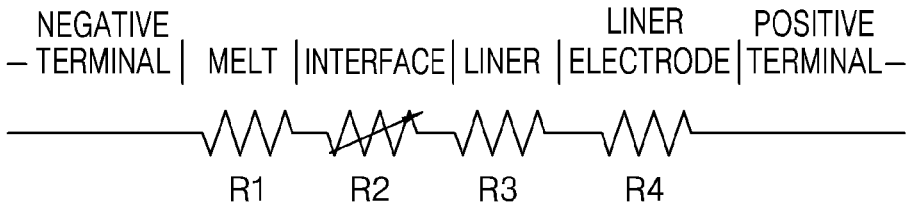
FIG. 5 is a conceptual diagram of an electrical circuit provided in a molten steel treatment apparatus in accordance with an exemplary embodiment.

FIG. 1 is a schematic view of a molten steel treatment apparatus in accordance with an exemplary embodiment, FIGS. 2 and 3 are schematic views of molten steel treatment apparatuses in accordance with modified embodiments, and FIG. 4 is a schematic view of an electrical circuit provided in a molten steel treatment apparatus in accordance with an exemplary embodiment. Also, FIG. 5 is a conceptual diagram of an electrical circuit provided in a molten steel treatment apparatus in accordance with an exemplary embodiment. Here, FIG. 2 is a schematic view illustrating a molten steel treatment apparatus in accordance with a first modified embodiment, and FIG. 3 is a schematic view illustrating a molten steel treatment apparatus in accordance with a second modified embodiment. Also, (a) of FIG. 4 is a schematic view of an electrical circuit provided in molten steel treatment apparatuses in accordance with an exemplary embodiment and the second modified embodiment, (b) of FIG. 4 is a schematic view illustrating a molten steel treatment apparatus in accordance with a first modified embodiment, and (c) of FIG. 4 is a schematic view illustrating an electrical circuit provided in a molten steel treatment apparatus, when a current measuring part is applied to a measuring part of the molten steel treatment apparatus in accordance with the first modified embodiment.

A molten steel treatment apparatus in accordance with an exemplary embodiment is the apparatus capable of treating an object to be treated in a molten state such as molten steel, the object being manufactured in steel-making equipment. More specifically, the molten steel treatment apparatus is the apparatus in which molten steel is received, is then stored in the apparatus for a predetermined time, and is then tapped such that the tapped amount of the molten steel is adjusted during the tapping of the molten steel. The exemplary embodiment illustrates continuous casting equipment as the steel-making equipment in which the molten steel treatment apparatus is applied. Accordingly, a container 100 of the molten steel treatment apparatus may include a tundish used in continuous casting equipment, and a lower nozzle 220 may include a submerged entry nozzle (SEN) equipped in the tundish. Of course, equipment in which the molten steel treatment apparatus in accordance with an exemplary embodiment is applied is not specifically limited to continuous casing equipment.

Hereinafter, a molten steel treatment apparatus in accordance with an exemplary embodiment will be described in detail with reference to FIGS. 1 to 5. As illustrated in FIG. 1, a molten steel treatment apparatus includes: a container 100 which has a space for receiving molten steel M and a molten steel tap hole 110 formed in a bottom surface thereof so as to tap the molten steel M; a nozzle 200 having an inner space through which the molten steel M passes and equipped in the molten steel tap hole 110; a liner 400 which is installed on at least a portion of the inner circumferential surface of the nozzle 200 and is formed of an ion-conductive material; a liner electrode 500 disposed between the nozzle 200 and the liner 400; a power supply 600 for applying electrical power to the molten steel M and the liner 400; and a measuring unit 700 for measuring a voltage value or a current value between the molten steel M and the liner 400.

A mold 10 is provided in a lower portion of the molten steel treatment apparatus, and the mold 10 receives the molten steel M tapped from the container 100 through the nozzle 200 of the molten steel treatment apparatus and solidifies the molten steel M in a slab-like shape.

The container 100, such as a tundish, has a shape of a container which is provided with a predetermined space capable of receiving the molten steel M therein and the inside of which is protected by a refractory material and can thereby temporarily store the molten steel M supplied from a ladle (not shown). The molten steel tap hole 110 is formed in the container 100 to vertically pass through the bottom surface of the container 100 so as to tap the molten steel M received in the container 100, and the nozzle 200 is equipped in the molten steel tap hole 110.

The nozzle 200 is equipped to vertically pass through the molten steel tap hole 110 in a lower side of the container 100. The nozzle 200 has a shape of a hollow tube vertically extending in the lengthwise direction, and can be manufactured of a refractory material. The nozzle 200 has opened upper and lower portions and is thereby provided with an inner space through which the molten steel M passes. The nozzle 200 includes an upper nozzle 210, a lower nozzle 220 such as a submerged entry nozzle. The nozzle 200 is equipped in the container 100 such that the upper nozzle 210 passes through the molten steel tap hole 110, and communicates with the container 100 such that the lower nozzle 220 is connected to the upper nozzle 210. A discharge hole is provided in an end portion of the lower nozzle 220 so that the molten steel M can be tapped. The molten steel M received in the container 100 is provided into the mold 10 through the molten steel tap hole 110, the inner space of the nozzle 200, and the discharge hole of the lower nozzle 220.

A sliding gate 300 is provided at one side of the nozzle 200 so that the tapped amount of molten steel M passing through the inner space of the nozzle 200 may be adjusted. The sliding gate 300 is disposed between the upper nozzle 210 and the lower nozzle 220, and adjusts the tapped amount of molten steel M by adjusting the opening of the nozzle 200.

Meanwhile, an inclusion, for example, an alumina inclusion may be mixed into the molten steel M. The inclusion mixed into the molten steel M may adhere to the inside of the nozzle 200 while the molten steel M is provided to the mold 10 passing through the nozzle 200. The inclusion adhering to the inside of the nozzle 200 irregularly reduce the inner diameter of the nozzle 200 and thereby irregularly change the tapped amount of molten steel M passing through the nozzle 200. This phenomenon is referred to as nozzle clogging. To suppress or prevent the nozzle clogging from occurring, the liner 400 formed of an ion-conductive material is provided on the inner circumferential surface of the nozzle 200, and electric power is applied to the liner 400 to remove the inclusion adhering to the inside of the nozzle 200 by deoxidizing the inclusion through an electrochemical method. Here, the deoxidizing rate of inclusion varies according to the current value of the applied power source, and thus, to effectively remove the inclusion, an adhesion state of the inclusion to an inside the nozzle should be quickly measured during an operation and the applied current value should be adjusted corresponding to the measured state. For this, in the current embodiment, a measuring unit 700 to be mentioned later is provided, and the adhesion state and the thickness of the inclusion inside the nozzle 200 can be quickly measured through the measuring unit 700.

The liner 400 has a shape of a film having predetermined area and thickness, and is disposed on at least a portion of the inner circumferential surface of the nozzle 200. The liner 400 may include a solid electrolyte, and the solid electrolyte may be, for example, zirconia ($ZrO_2$). Ions can move inside the solid electrolyte, and the liner 400 has ion conductivity due to the solid electrolyte. That is, a passage through which ions can move may be formed, by the liner 400, on the inner circumferential surface of the nozzle 200. During an operation, the liner 400 contacts the molten steel M, and an interface 410 is formed on the inner circumferential surface of the liner 400 through the contact of the molten steel M and the liner 400 which have material phases different from each other. Electric power is applied to the liner 400 during an operation, and an electromechanical reduction reaction is derived in an inclusion 1, such as alumina inclusions ($Al_2O_3$), adhering to the interface 410 of the liner 400 during an operation by the applied electric power. Accordingly, the inclusion 1 is decomposed into oxygen ions and metal ions, the oxygen ions are moved toward a positive electrode inside the liner 400 and are then removed from molten steel M, and the metal ions are mixed into the molten steel M.

The liner electrode 500 may be disposed between the liner 400 and the nozzle 200. The liner electrode 500 functions to apply electric power to the liner 400. Here, electric power is applied to the molten steel M corresponding to the electric power applied to the liner electrode 500. For example, a positive pole of DC current is applied to the liner electrode 500 and a negative pole of DC current is applied to the molten steel M. Alternatively, for example, a positive pole of DC voltage is applied to the liner electrode 500 and a negative pole of DC voltage is applied to the molten steel M. A flow of electricity may be formed in the liner 400 by the liner 400 and the molten steel M. The material of the liner electrode 500 may include a carbon material.

The power supply 600 is provided outside the container 100 and the nozzle 200 and functions to apply electric power, such as DC current or DC voltage to the molten steel M and the liner 400. The power supply 600 may include a DC power source capable of applying DC current or DC voltage to the molten steel M and the liner 400. The negative terminal of the DC power source is connected to the molten steel M, and the positive terminal of the DC power source is connected to the liner electrode 500 or to the nozzle 200. More specifically, when the liner electrode 500 is disposed between the nozzle 200 and the liner 400, the positive terminal of the DC power source is connected to the liner electrode 500, and in other cases, the positive terminal of the DC power source is connected to the nozzle 200. When the positive terminal of the DC power source is connected to the nozzle 200, the nozzle 200 may contain carbon of approximately 20 wt % or more to the total weight, and the nozzle 200 may thereby have desired electrical conductivity. As described above, the DC power source applies the negative pole to the molten steel M and applies the positive pole to the liner electrode 500 or the nozzle 200.

The measuring unit 700 (700*a* and 700*b*) may include: a measuring part 710 (711 and 712) for measuring a voltage value or a current value between the molten steel M and the liner 400; an arithmetic part 720 connected to the measuring part 710, and calculating a resistance value by using a voltage value or a current value inputted from the measuring part and the applied voltage value or the applied current value applied from the power supply 600; and a determination part 730 which is connected to the arithmetic part and determines the thickness of an inclusion adhering to the interface 410 between the molten steel M and the liner 400 by comparing a resistance value inputted from the arithmetic part 720 with a preset reference resistance value, or by comparing the voltage value or the current value inputted from the measuring part 710 with the preset reference voltage value or reference current value. Here, the measuring part 710 may include a voltage measuring part 711 capable of measuring a voltage value and a current measuring part 712 capable of measuring a current value. For example, corresponding to the case in which the power supply 600 applies a predetermined intensity of DC current to the molten steel M and the liner 400, a first measuring unit 700*a* including the voltage measuring part 711, the arithmetic part 720, and the determination part 730 may be connected to the power supply 600 (see (a) and (b) of FIG. 4). Alternatively, corresponding to the case in which the power supply 600 applies a predetermined intensity of DC voltage to the molten steel M and the liner 400, a second measuring unit 700*b* including the current measuring part 712, the arithmetic part 720, and the determination part 730 may be connected to the power supply 600 (see (c) of FIG. 4). As described above, the first and second measuring units 700*a* and 700*b* may be selected and applied to the molten steel treatment apparatus in accordance with an exemplary embodiment corresponding to the electric power applied from the power supply 600.

The above-mentioned measuring unit 700, by using the measuring part 710, measures the voltage value between the molten steel M and the liner 400 by using the measuring part 710 when the power supply 600 applies DC current to molten steel M and the liner 400, and measures the current value between the molten steel M and the liner 400 when the power supply 600 applies DC voltage to the molten steel M and the liner 400. Also, the measuring unit 700 may calculate a resistance value from the measured current value or the measured voltage value by using the arithmetic part 720. This will be described below. When the power supply 600 applies DC current to the molten steel M and the liner 400, the measuring part 710 measures the voltage value between the molten steel M and the liner 400, and the arithmetic part 720 calculates a resistance value by using the applied current value inputted from the power supply 600 and the measured voltage value inputted from the measuring part 710. Also, when the power supply 600 applies DC voltage to the molten steel M and the liner 400, the measuring part 710 measures the current value between the molten steel M and the liner 400, and the arithmetic part 720 may calculate a resistance value by using the applied voltage value inputted from the power supply 600 and the measured current value inputted from the measuring part 710. Also, the measuring unit 700 may determine, by using the determination part 730, the thickness of an inclusion adhering to the interface 410 and the adhesion state of the inclusion from the calculated resistance value, the measured voltage value, or the measured current value. Accordingly, the molten steel treatment apparatus in accordance with the current embodiment can quickly measure the adhesion state of the inclusion and the thickness of the inclusion during an operation.

To avoid overlapping descriptions, a detailed description of the feature in which the measuring unit 700 measures the current value or the voltage value between the molten steel M and the liner 400, calculates the resistance value, and determines the adhesion state of the inclusion and the thickness of the inclusion inside the nozzle 200 will be given later together with a description of the molten steel treatment method in accordance with the current embodiment.

Meanwhile, the molten steel treatment apparatus in accordance with an exemplary embodiment may be variously configured to include modified embodiments to be described below.

Firstly, referring to FIG. 2 and (b) of FIG. 4, the molten steel treatment apparatus in accordance with a first modified embodiment will be described, and then, referring to FIG. 3 and (a) of FIG. 4, the molten steel treatment apparatus in accordance with a second modified embodiment will be described. Here, the features different from the molten steel treatment apparatus in accordance with an exemplary embodiment will be mainly described, and hereinafter, other features will not be described since the configuration is similar to those of the molten steel treatment apparatus in accordance with an exemplary embodiment.

In the molten steel treatment apparatus in accordance with the first modified embodiment, as illustrated in FIG. 2 and (b) of FIG. 4, the positive terminal of the DC power source may be connected to the nozzle 200. That is, in the molten steel treatment apparatus in accordance with the first modified embodiment, the nozzle 200 may be used as an electrode without providing a separate electrode. For this, the nozzle 200 contains an electrically conductive material, such as carbon. Also, in order to have desired electrical conductivity, the nozzle 200 may contain carbon of approximately 20 wt % or more to the total weight of the nozzle 200.

In the molten steel treatment apparatus in accordance with the second modified embodiment, as illustrated in FIG. 3, the liner 400 and the liner electrode 500 may be disposed on a portion of the inner circumferential surface of the nozzle 200. Here, an electrical circuit provided in the molten steel treatment apparatus in accordance with the second modified embodiment has a configuration similar to that of the molten steel treatment apparatus in accordance with an exemplary embodiment, and this is illustrated in (a) of FIG. 4. In the molten steel treatment apparatus in accordance with the second modified embodiment, the liner 400 and the liner electrode 500 are disposed on the inner circumferential surface of the nozzle 200 at at least one or more desired positions, and can quickly measure the inclusion adhesion state and the thickness of the inclusion at the disposed positions. Here, the position at which the liner 400 and the liner electrode 500 are disposed may be a position at which a great amount of inclusion adheres to the inside of the nozzle 200, for example, an upper region of the nozzle 200 from which the molten steel M is introduced or a lower region of the nozzle 200 through which the molten steel M is discharged.

Figure 6:
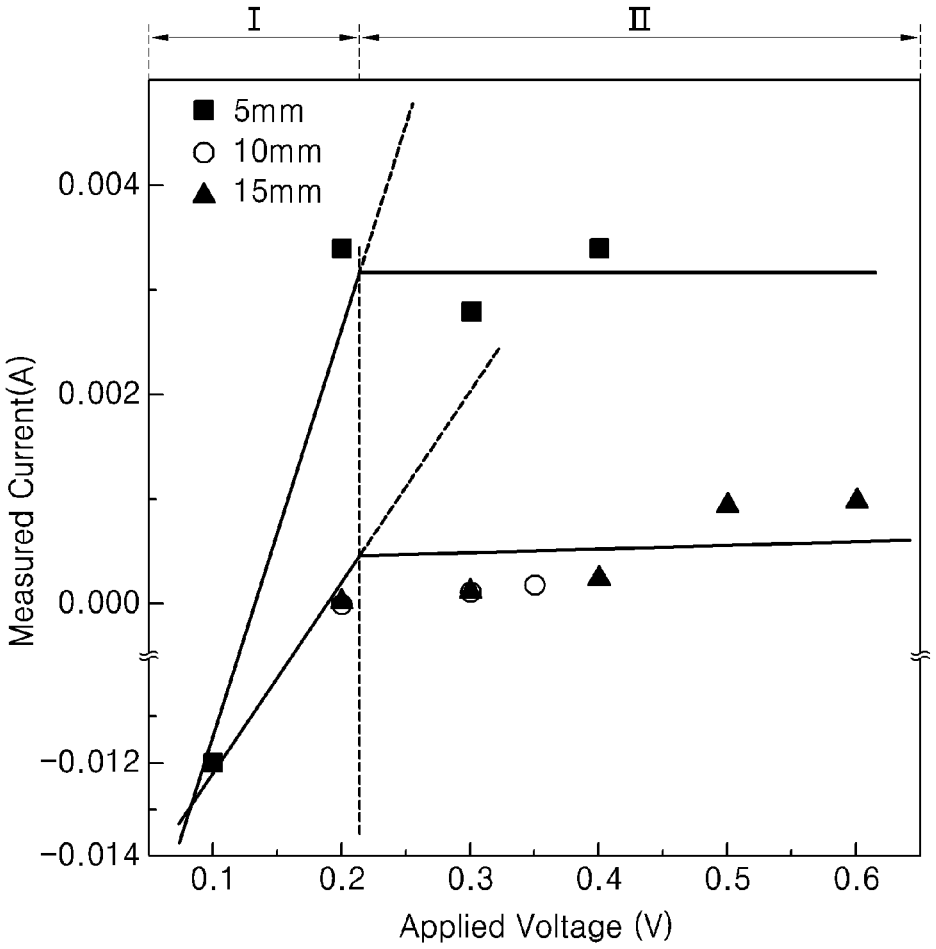
FIG. 6 is a graph illustrating result values after performing an experiment of properties of a solid electrolyte in accordance with an exemplary embodiment.

FIG. 6 is a graph illustrating result values after performing an experiment of properties of a solid electrolyte in accordance with an exemplary embodiment.

Before describing the molten steel treatment method in accordance with an exemplary embodiment, referring to FIG. 6, an experimental result of a property in which resistance varies as an inclusion is formed between the solid electrolyte and the molten steel in an electrochemical circuit including a positive electrode, a solid electrolyte, the molten steel, and a negative electrode will be described.

To perform the above-mentioned property experiment, a container (hereinafter, referred to as a specimen) having a predetermined size is formed of MgO stabilized $ZrO_2$ (MSZ), and a crucible filled with the molten steel is provided. The specimen is immersed into the crucible filled with the molten steel at a depth of approximately 5 mm, and then a positive pole is connected to the specimen and a negative pole is connected to the molten steel to constitute an electrochemical circuit. DC voltage is applied to the constituted electrochemical circuit, and then a current value between the specimen and the molten steel is measured while increasing the voltage value of the DC voltage. Here, oxygen is supplied to the interface between the specimen and the molten steel to cause an inclusion ($Al_2O_3$) to be formed between the specimen and the molten steel. After completing the experiment, the experiment is repeatedly performed while changing immersing depth to approximately 10 mm and approximately 15 mm.

Results of the experiment performed as the above is illustrated in FIG. 6. As illustrated in FIG. 6, after starting the experiment, it can be understood that in a first interval (I), the current value between the specimen and the molten steel is linearly increased according to the increase of the voltage value However, in a second interval (II) after the first interval (I), it can be understood that even when the voltage value is increased, the current value between the specimen and the molten steel is not increased to a value expected corresponding to the increase of the voltage value. Through this, it can be understood that a resistance value between the specimen and the molten steel is increased between the first interval and the second interval, and the increase in the resistance value is caused by causing the formation of an inclusion between the specimen and molten steel. That is, the inclusion adheres to the specimen, and the adhering inclusions function as a resistance interrupting a current flow between the specimen and the molten steel. Accordingly, the total resistance value in the electrochemical circuit is increased after the adhesion of the inclusion, and the current value is not increased by an amount of increase in the voltage value, and thus the slope of the measured voltage and current values is changed.

As described above, it can be understood that an inclusion adhering to the interface formed between the molten steel and the solid electrolyte correlates with the resistance value between the molten steel and the solid electrolyte. Accordingly, using this, in the molten steel treatment apparatus and the molten steel treatment method in accordance with exemplary embodiment, the adhesion state of the inclusion and the thickness of the inclusion can be effectively determined during an operation, and operation conditions are thereby adjusted, and thus the nozzle clogging can be effectively suppressed or prevented.

Hereinafter, the molten steel treatment method in accordance with an exemplary embodiment will be described. Here, for convenience in description, the molten steel treatment method in accordance with an exemplary embodiment will be described with reference to the molten steel treatment apparatus illustrated in FIGS. 1 to 5 in accordance with an exemplary embodiment.

A molten steel treatment method in accordance with an exemplary embodiment includes: preparing molten steel M in a container 100; tapping the molten steel M prepared in the container 100; applying electric power to the molten steel M and a liner 400 disposed on the inner circumferential surface of a nozzle 200 for tapping the molten steel M; measuring a voltage value or a current value between the molten steel M and the liner 400; and determining the thickness of an inclusion 1 adhering to an interface 410 between the molten steel M and the liner 400 by using the measured voltage or current value.

First, a molten steel treatment apparatus to which the molten steel treatment method in accordance with exemplary embodiment is applied will be briefly described. The molten steel treatment apparatus includes a container 100 capable of receiving molten steel, and a nozzle 200 equipped in a molten steel tap hole 110 provided in the container 100, and a liner electrode 500 and a liner 400 are sequentially provided on the inner surface of the nozzle 200. A slide gate 300 capable of adjusting the opening of the nozzle 200 is equipped at one side of the nozzle 200. A power supply 600 for applying electric power to the molten steel M and the liner 400 is provided outside the nozzle 200, and an electrochemical circuit including the power supply 600, the molten steel M, and the liner 400 is constituted. A measuring unit 700 capable of measuring a voltage value or a current value between the molten steel M and the liner 400 is connected to the electrochemical circuit including the power supply 600, the molten steel M, and the liner 400. A mold 10 is provided at a lower side of the above-mentioned molten steel treatment apparatus, and the molten steel M in the container 100 is supplied into the mold 10 through the nozzle 200.

First, the molten steel M is prepared in the container 100. A transporting container (not shown) for transporting the molten steel M such as a ladle is moved to an upper side of the container 100, and is then tilted to provide the molten steel in the container 100.

Subsequently, the molten steel M provided in the container 100 is tapped. The molten steel M is tapped by opening the nozzle 200 by using the slide gate 300 equipped in the nozzle 200. Here, the sliding gate 300 may adjust the tap amount and tap rate of molten steel M by adjusting the opening of the nozzle 200.

When the molten steel M is tapped, electric power is applied to the molten steel M and the liner 400. In the applying of electric power, a negative terminal of a DC power source is connected to the molten steel M, and a positive terminal of the DC power source is connected to the liner electrode 500 disposed between the liner 400 and the nozzle 200 (see (a) of FIG. 4) or to the nozzle 200 (see (b) of FIG. 4), and thus, DC current or DC voltage may be applied to the molten steel M and the liner 400.

Before describing the measuring of the voltage value or current value, referring to FIGS. 4 and 5, the electrochemical circuit including the power supply 600, the molten steel M, and the liner 400 will be described. As illustrated in (a) of FIG. 4, the electrochemical circuit provided in the molten steel treatment apparatus in accordance with an exemplary embodiment includes a positive terminal of the DC power source, the liner electrode 500, the liner 400, the interface 410, the molten steel M, and the negative terminal of the DC power source, which are respectively electrically connected to each other. Here, respective resistances R1, R3, and R4 of the molten steel M, the liner 400, and the liner electrode 500 have constant values which are given according to electrical characteristics of respective materials or are measurable, and the resistance of the interface 410 is a variable value which varies according to an inclusion adhering during an operation. This is simply illustrated in FIG. 5. The total resistance of the electrochemical circuit is the sum of the resistance R1 of molten steel M, the resistance R2 of the interface 410, the resistance R3 of the liner 400, and the resistance R4 of the liner electrode 410. To measure a voltage value or a current value between the molten steel M and the liner 400, a measuring unit 700 is connected to the above-mentioned electrochemical circuit. The measuring unit 700 is configured as follows. The measuring unit 710 includes: a measuring part 710 connected to the electrochemical circuit and measuring a voltage value or a current value; an arithmetic part 720 connected to the measuring part 710 and calculating a resistance value; and a determination part 730 for determining the thickness of the inclusion adhering to the interface 410. Here, the measuring part 710 includes a voltage measuring part 711 such as a voltmeter, and a current measuring part 712 such as an ammeter, and one of the voltage measuring part 711 or the current measuring part 712 is selected corresponding to electrical power applied from the DC power source and is then connected to the electrochemical circuit. When DC current is applied from the DC power source, the voltage measuring part 711, as illustrated in (a) or (b) of FIG. 4, is connected to the electrochemical circuit so as to be connected in parallel with the DC power source. When DC voltage is applied from the DC power source, the current measuring part 712, as illustrated in (c) of FIG. 4, is connected to the electrochemical circuit so as to be connected in series with the DC power source. To calculate the resistance R2 of the interface 410, the current value and the voltage value, which are measured in the electrochemical circuit, are used. For example, the total resistance value of the electromechanical circuit can be calculated from the voltage value measured from the voltage measuring part 711 and the applied current value of DC current applied from the DC power source, and the resistance value of the resistance R2 of the interface 410 can be calculated by subtracting resistances R1, R3, and R4, which have given values, from the total resistance value. Also, the total resistance value of the electromechanical circuit can be calculated from the current value measured from the current measuring part 712 and the applied voltage value of DC voltage applied from the DC power source, and the resistance value of the resistance R2 of the interface 410 can be calculated by subtracting resistances R1, R3, and R4 which have given values from the total resistance value.

After applying electric power to the molten steel M and the liner 400, the voltage value or the current value between the molten steel M and the liner 400 is measured. In measuring of the voltage value or the current value, when DC current is applied to the molten steel M and the liner 400, the voltage value between the molten steel M and the liner 400 is measured, and when DC voltage is applied to the molten steel M and the liner 400, the current value between the molten steel M and the liner 400 is measured. The voltage value or the current value is measured in real time, and may be continuously measured at regular intervals. For example, the voltage value or the current value is continuously measured at regular intervals of approximately 0.2 second while performing an operation.

After the measuring of the voltage value or the current value, calculating a resistance value between the molten steel M and the liner 400 may be performed. In the calculating of the resistance value, when DC current is applied to the molten steel M and the liner 400, the resistance value is calculated on the basis of, for example, Ohm's law by using the applied current value of DC current and the measured voltage value, and when DC voltage is applied to the molten steel M and the liner 400, the resistance value is calculated by using the applied voltage value of DC voltage and the measured current value. The resistance value is calculated in real time corresponding to the measuring of the voltage value or the current value, and may be continuously measured at regular intervals. For example, when the voltage value or the current value is continuously measured at regular intervals of approximately 0.2 second, the resistance value is also continuously measured at regular intervals of approximately 0.2 second.

Through the above-mentioned process, the voltage value or the current value is measured, and by using this, the resistance value is then measured. Subsequently, the determining of the thickness of the inclusion adhering to the interface 410 between the molten steel M and the liner 400 is performed. Here, after starting the tapping of the molten steel M, at a time when the flow of the molten steel M is stabilized inside the nozzle 200, the determining of the thickness of the inclusion adhering to the interface 410 between the molten steel M and the liner 400 is performed. Here, the time when the flow of the molten steel M is stabilized inside the nozzle 200 means the time when the molten steel M uniformly passes through the nozzle 200 over the entire region of the nozzle 200 and the flow of the molten steel M is thereby stabilized.

Here, determining an adhesion state of the inclusion to the interface 410 may be performed between the calculating of the resistance value between the molten steel M and the liner 400 and the determining of the thickness of the inclusion adhering to the interface 410. This will be described below.

Before the determining of the thickness of the inclusion 1, the determining of the adhesion state of the inclusion to the interface 410 is performed. The determining of the adhesion state of the inclusion to the interface 410 may be performed in real time during an operation, and may be continuously performed at regular intervals. In the determining of the adhesion state of the inclusion, when the measured voltage value is equal to or more than a reference voltage value, the measured current value is equal to or less than a reference current value, or the calculated resistance value is equal to or more than the reference resistance value after comparing the measured voltage value, the measured current value, or the calculated resistance value with the preset reference voltage value, the preset reference current value, or the preset reference resistance value, the interface 410 is determined as an adhesion state of the inclusion, and when the measured voltage value is less than the reference voltage value, the measured current value is more than the reference current value, and the calculated resistance value is less than the reference resistance vale, the interface 410 is determined as a non-adhesion state of the inclusion. Using this, the adhesion state of the inclusion to an inside the nozzle 200 can be quickly measured during an operation.

Hereinafter, a method for setting the reference voltage value, the reference current value, and the reference resistance value will be described as follows. Molten steel treatment operation is repeatedly performed by using a molten steel treatment apparatus in accordance with an exemplary embodiment. As the operation is repeatedly performed, the measured voltage and current values and the calculated resistance value are quantified. The quantified values are analyzed according to elapsed time of an operation, that is, are analyzed in time series, and thus the adhesion time of inclusion is inductively inferred. For example, after starting the tapping of the molten steel M, when the flow of the molten steel M is stabilized, the measured voltage value and the calculated resistance value have constant values within a predetermined range. However, the case in which the voltage value is abruptly increased occurs, and the case can be understood as being caused by an increase in the resistance value. Also, it can be understood that the increase in the resistance value is due to inclusion adhesion to the interface 410 of the liner 400.

Figure 7:
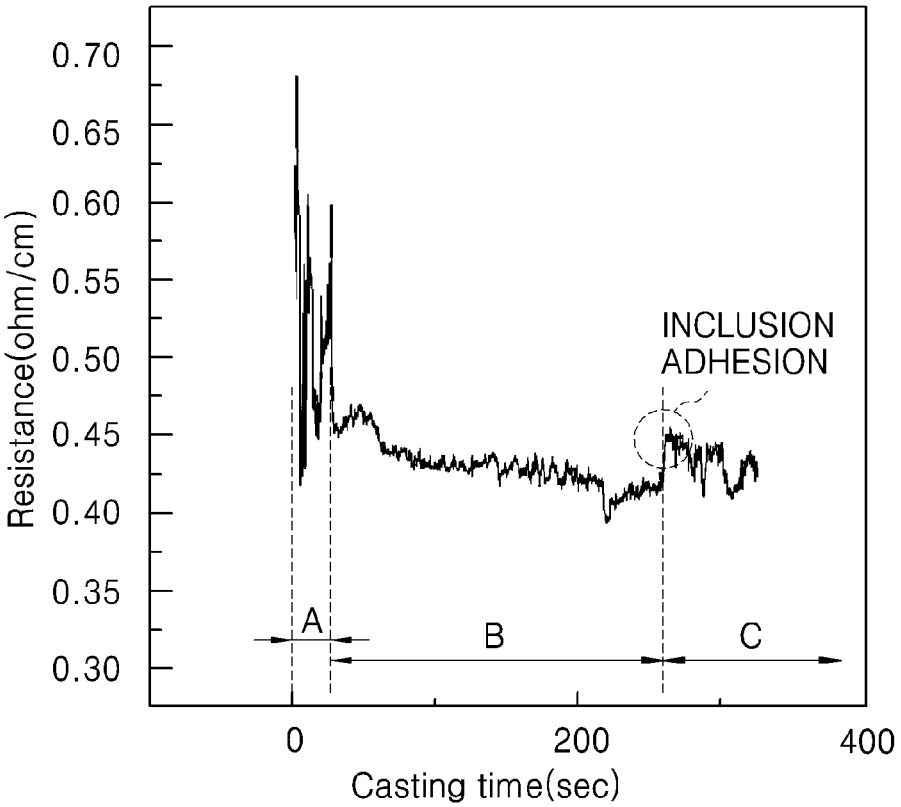
FIG. 7 is a graph illustrating result values after performing an operation in accordance with an exemplary embodiment.

This is illustrated in FIG. 7. FIG. 7 is a graph illustrating result values after performing operation in accordance with an exemplary embodiment. Hereinafter, referring to FIG. 7, a method for setting the reference voltage value, the reference current value, and the reference resistance value will be described.

Conditions for performing an operation are as follows. The operation was repeatedly performed five times at a casting rate of approximately 0.8 m/min for high-alumina and high-titanium molten steel of approximately 10 ton. Here, DC current of approximately 1.0 A was applied to the molten steel M and the liner 400 by using a power supply 600, and a voltage value was measured by using a measuring unit 700. Here, the interval of measurement was approximately 0.2 second. Then, the total resistance was calculated by using the measured voltage value. The amounts of increase in the voltage value and the resistance value are quantified in time series as illustrated in FIG. 7. Referring to FIG. 7, the molten steel passes a non-uniform flow interval A at an initial casting stage, and then passes through an interval B in which the flow of the molten steel is stabilized. The resistance value is maintained within a predetermined range at an end portion of the interval B in which the flow of molten steel is stabilized. Here, an interval C in which the resistance value is abruptly increased or decreased occurs. The time when the resistance value is abruptly increased or decreased may be inferred as the adhesion time of inclusion. The casting rate of the nozzle 200, a tapping amount of molten steel, and the inner diameter of the nozzle are information given according to the conditions of operation. Accordingly, the change in the inner diameter of the nozzle 200, that is, the thickness of the adhering inclusion can be quantified through the information about the tapping amount of molten steel, and the inner diameter of the nozzle at the time when the resistance value is increased. Thus, a data base can be set up by obtaining the information about the adhesion state of the inclusion and the thickness of the inclusion corresponding to the resistance value. By using the set up data base, the voltage value, the current value, and the resistance value at the time when the inclusion adheres to the inside of the nozzle are set as the reference voltage value, the reference current value, and the reference resistance value After the determining of the adhesion state of the inclusion to the interface 410, the determining of the thickness of inclusions is performed. In the determining the thickness of the inclusion, when the interface 410 is determined as an adhesion state of the inclusion, it can be determined that: the thickness of the inclusion adhering to the interface 410 is increased as the measured voltage value or the measured resistance value is increased, or as the measured current value is decreased, and the thickness of the inclusion adhering to the interface 410 is decreased as the measured voltage value or the measured resistance value is decreased, or as the measured current value is increased.

As such, in the current embodiment, the increase or decrease of the inclusion adhering to the interface 410 may be determined by using the result values. In addition, when the relation between the result values and the thickness of adhering inclusion is digitized and quantified after repeatedly performing operation, not only the above-mentioned change in the thickness of the inclusion but also the thickness value of the inclusion can be, of course, determined.

Meanwhile, in the determining of the thickness of the inclusion, when the interface 410 is determined as a non-adhesion state of the inclusion, the thickness of the inclusion may well not be determined. Also, in performing the determining of the thickness of the inclusion, when a voltage value or a resistance value is decreased to a value less than the reference voltage or the reference resistance value, the interface 410 is determined as a non-adhesion state of the inclusion, and then returning to the previous step, the determining of an adhesion state of the inclusion is performed. Similarly, in performing the determining of the thickness of the inclusion, when a current value is increased to a value more than the reference current value, the interface 410 is determined as a non-adhesion state of the inclusion, and then returning to the previous step, the determining of an adhesion state of the inclusion is performed.

After the determining of the thickness of the inclusion, a subsequent step is performed according to the thickness of the inclusion. More specifically, in performing a subsequent step, when the interface 410 is determined as the adhesion state of the inclusion, the tap rate of the molten steel M is increased or a current value between the molten steel M and the liner 400 is increased, and thus the inclusion adhering to the interface 410 is removed to solve nozzle clogging due to the adhering inclusion. Also, when the interface 410 is determined as the non-adhesion state of the inclusion, the tap rate of the molten steel M is maintained or a current value between the molten steel M and the liner 400 is maintained. Here, methods for increasing the tap rate of molten steel M includes a method for increasing the opening of the nozzle 200 by using, for example, the slide gate 300. When the tap rate of molten steel M is increased, an effect in that the inclusion adhering to the nozzle 200 is removed can be achieved. Also, when a current value between the molten steel M and the liner 400 is increased, an electrochemical deoxidization phenomenon is increased, and thus an effect of increasing the decomposition rate of inclusion can be achieved. As such, an adhesion state of the inclusion to the interface 410, that is, the nozzle clogging, can be solved by increasing the tap rate of molten steel M and the current value between the molten steel M and the liner 400 to quickly remove the inclusion adhering to the interface 410. When the adhesion state of the inclusion to the interface 410, that is, the nozzle clogging, is solved, the resistance of the interface 410 is decreased. Accordingly, a voltage value or a resistance value is decreased and is thereby defined in a range smaller than the reference voltage value or the reference resistance value, and current value is increased and is thereby defined in a range greater than the reference current value. This can be measured from the measuring part 710 during an operation, and the measured values are fed back and can thereby be used to accurately determine the adhesion state of the inclusion to the interface 410. Also, when the thickness of the inclusion adhering to the interface 410 is determined to be increased, the tap rate of molten steel M and the current value between molten steel M and the liner 400 is gradually increased, and thus, the adhesion state of the inclusion to the interface 410 can be more effectively solved.

In the molten steel treatment method performed as described above, while performing an operation of treating the molten steel, the measuring of the current value or the voltage value, the determining of the adhesion state of the inclusion, the determining of the thickness of the inclusion, the performing of a subsequent step are continuously performed at regular time intervals, and thus, the nozzle clogging of equipment can be quickly measured. Accordingly, when nozzle clogging occurs during an operation, the separation and decomposition of the adhering inclusion are promoted and the nozzle clogging can thereby be quickly solved. Thus, the stability and productivity of operation can be improved.

The above exemplary embodiment illustrates continuous casting equipment and an operation thereof, but may be applied to other various operations of treating an object to be treated. Various embodiments may be provided to allow those skilled in the art to understand the scope of the preset invention.

The invention claimed is:

1. A molten steel treatment apparatus comprising:

a container having a space for receiving molten steel and a molten steel tap hole formed in a bottom surface thereof so as to tap the molten steel;

a nozzle equipped in the molten steel tap hole and having an inner space through which the molten steel passes;

a slide gate equipped in the nozzle and configured to control a tap rate of the molten steel;

a liner installed on at least a portion of an inner circumferential surface of the nozzle, the liner being formed of an ion-conductive material;

a power supply for applying an electric power to the molten steel and the liner; and a measuring unit configured to measure a voltage value or a current value between the molten steel and the liner and calculate a resistance value of an interface between the molten steel and the liner, wherein the measuring unit is further configured to compare the measured voltage value with a preset reference voltage value, the measure current value with a preset reference current value, or the calculated resistance value with a preset reference resistance value, and determine an adhesion of inclusion to the interface and a thickness of the inclusion adhering to the interface using a result of the comparison, wherein the slide gate is configured to increase the tap rate of the molten steel when determined that an inclusion is adhered to the interface, or wherein the power supply is configured to increase a current value being applied between the molten steel and the liner when determined that an inclusion is adhered to the interface.

2. The molten steel treatment apparatus of claim 1, wherein the electric power includes a DC current or a DC voltage.

3. The molten steel treatment apparatus of claim 1, wherein the ion-conductive material comprises a solid electrolyte.

4. The molten steel treatment apparatus of claim 1, further comprising a liner electrode disposed between the nozzle and the liner, wherein the electric power is applied to the liner through the liner electrode.

5. The molten steel treatment apparatus of claim 4, wherein the power supply comprises a DC power source capable of applying a DC current or a DC voltage, wherein a negative terminal of the DC power source is connected to the molten steel, and a positive terminal of the DC power source is connected to the liner electrode.

6. The molten steel treatment apparatus of claim 1, wherein the nozzle contains an electrically conductive material, and the power supply comprises a DC power source capable of applying a DC current or a DC voltage, wherein a negative terminal of the DC power source is connected to the molten steel, and a positive terminal of the DC power source is connected to the nozzle.

7. The molten steel treatment apparatus of claim 1, wherein the measuring unit comprises:

a measuring part connected to the power supply and configured to measure the voltage value or the current value;

an arithmetic part connected to the measuring part, and configured to calculate the resistance value; and a determination part connected to the arithmetic part and configured to determine the adhesion of inclusion and the thickness.

8. A molten steel treatment method comprising:

preparing molten steel in a container, the container having a molten steel tap hole formed in a bottom surface thereof;

tapping the molten steel through a nozzle attached to the molten steel tap hole;

applying an electric power to the molten steel and a liner disposed on an inner circumferential surface of the nozzle;

measuring a voltage value or a current value between the molten steel and the liner;

calculating a resistance value of an interface between the molten steel and the liner by using the measured voltage value or the measured current value;

determining that an inclusion is adhered to the interface when the measured voltage value is equal to or more than a preset reference value, the measured current value is equal to or less than a preset reference current value, or the calculated resistance value is equal to or more than a preset reference resistance value;

comparing the measured voltage value with the preset reference voltage value, the measure current value with the preset reference current value, or the calculated resistance value with the preset reference resistance value, and determining a thickness of the inclusion using a result of the comparison; and increasing a tap rate of the molten steel or a current value being applied between the molten steel and the liner when determined that an inclusion is adhered to the interface.

9. The molten steel treatment method of claim 8, wherein the electric power comprises a DC current or a DC voltage.

10. The molten steel treatment method of claim 9, wherein the measuring comprises: measuring the voltage value when the electric power is the DC current, or measuring the current value when the electric power is the DC voltage.

* * * * *